United States Patent [19]

Williams

[11] 4,142,329

[45] Mar. 6, 1979

[54] CATCH BASIN GRATE AND RECEIVING FRAME LOCKING ASSEMBLY

[76] Inventor: Robert C. Williams, Rte. 1, Box 343, Orting, Wash. 98360

[21] Appl. No.: 845,291

[22] Filed: Oct. 25, 1977

[51] Int. Cl.[2] ..... E05C 21/02

[52] U.S. Cl. ..... 49/465

[58] Field of Search ..... 49/463, 465

[56] References Cited

U.S. PATENT DOCUMENTS

| | | | |
|---|---|---|---|
| 1,542,900 | 6/1925 | Maddocks | 49/465 |
| 1,693,190 | 11/1928 | Benedetti | 49/465 |
| 2,009,132 | 7/1935 | Gehris | 49/465 |

*Primary Examiner*—Kenneth Downey
*Attorney, Agent, or Firm*—Roy E. Mattern, Jr.

[57] ABSTRACT

A catch basin grate and receiving frame locking assembly is installed on a catch basin grate and interfitted with a receiving frame, in turn imbedded in a pavement, thereby preventing the removal of the catch basin grate only by a designated workman having a special pivotal lever tool. On one side of the catch basin grate a depending structure is either made integrally with the grate or bolted to it, and it supports a horizontal projecting portion which interfits with the receiving frame. On the opposite side of the catch basin grate, two depending structures are either made integrally with the grate or bolted to it and they support a horizontal movable locking member. It has a compression coiled spring subassembly, which keeps the horizontal movable locking member engaged with the receiving frame, until a removable pivotal lever is used to move the horizontal movable locking member against the force of the coiled spring and clear of the receiving frame, thereby permitting the catch basin grate to be intentionally removed.

3 Claims, 4 Drawing Figures

CATCH BASIN GRATE AND RECEIVING FRAME LOCKING ASSEMBLY

BACKGROUND OF THE INVENTION

The various accesses needed through paved roadways to reach utilities and to provide drainage are covered to prevent accidents with a heavy top fitting into a receiving frame imbeeded in the pavement. Often because of its weight the heavy top is just lowered into place and not secured. However, some tops have been fastened in place. For example Mr. Wirz in 1943 in his U.S. Pat. No. 2,323,886 illustrates a manhole cover interlocked with a complementary receiving frame which are so desgined together from the outset. Mr. Blakeman in 1944 in his U.S. Pat. No. 2,363,567 discloses a coverplate with radially operating mechanisms to lock the coverplate with a complementary receiving frame which are so designed together from the outset. Also Mr. Thompson in 1905 in his U.S. Pat. No. 791,381, describes and illustrates his receiver or catch basin having a grate with special receiving structures designed as extensions, which serve as places for securing pivotal hooks mounted on the interior walls of the catch basin at the time of manufacture of the entire covered receiver or catch basin.

Although these prior securement arrangements are provided, there has been a continued production of the standard heavy catch basin grates which are lowered into the receiving frames and not thereafter locked in any way. Yet in some municipal areas there is a need to lock them in place to avoid their loss through theft and vandalism. Therefore there is a need for a locking assembly to be easily installed on existing catch basin grates so they may be locked to their receiving frames to avoid their loss by the acts of thieves and vandals.

SUMMARY OF THE INVENTION

A catch basin grate and receiving frame locking assembly is provided in one embodiment to be conveniently added to existing previously unlockable installed catch basins, to thereafter prevent loss of the catch basin grate through theft or vandalism. In another embodiment, with respect to the manufacture of future catch basin grates, only three depending structures are formed during the initial casting, and thereafter, the balance of the locking assembly components are utilized to provide the needed locking capability.

In both embodiments, at one underside of the catch basin grate, depending structure, either bolted in place or originally cast, is provided with a horizontal projecting portion to interfit with the side of a receiving frame that is to support the catch basin grate. Also in both embodiments, at the opposite underside of the catch basin grate, two spaced depending structures, either bolted in place or originally cast are provided with longitudinally aligned receiving holes. A longitudinally movable locking member is located throughout and beyond these aligned receiving holes, and equipped with a coiled compression spring subassembly, including, in addition to the spring, a movable spring contact washer having a horizontal projection portion at its top and secured to the longitudinal movable locking member to confine the spring between itself and one of the two spaced depending structures. Also there is a retaining washer secured to the horizontally movable locking member at its end nearest the central portions of the catch basin grate to retain it in position under spring force during the interfitting of the movable locking member with the receiving frame to thereby lock the catch basin grate to the receiving frame. The intentional removal or unlocking occurs as a designated maintenance man carrying a special pivotal lever uses it to engage its lower angled notched end with the horizontal projection portion on the top of the movable spring contact washer. Once engaged, the pivotal lever is moved to compress the spring and to retract the horizontal movable locking member from its interfitting spring loaded contact position with the receiving frame of the catch basin grate.

Both embodiments, as installed and operated, serve to positively lock the catch basin grate to the receiving frame making it impossible for the grate to be removed by thieves or vandals, unless they gain access to information concerning the use of the unlocking tool and/or to the tool itself. The retrofit embodiment is especially adapted for installation on all the unlockable installations of the catch basin grates and their receiving frames. The installation is readily undertaken. As time goes on replacement catch basin grates and new grates are easily modified to include the three depending structures. Both embodiments are comparatively undertaken at low cost, yet when installed save the costs of replacement of those grates wrongfully removed. There is the realization also that the accesses will not be left uncovered unwantedly serving as dangerous traps to possibly result in personal injuries and property damage as persons and their vehicles are hindered in their travels.

DESCRIPTIONS OF THE DRAWINGS

Two embodiments are illustrated in the drawings wherein.

Figure 3:
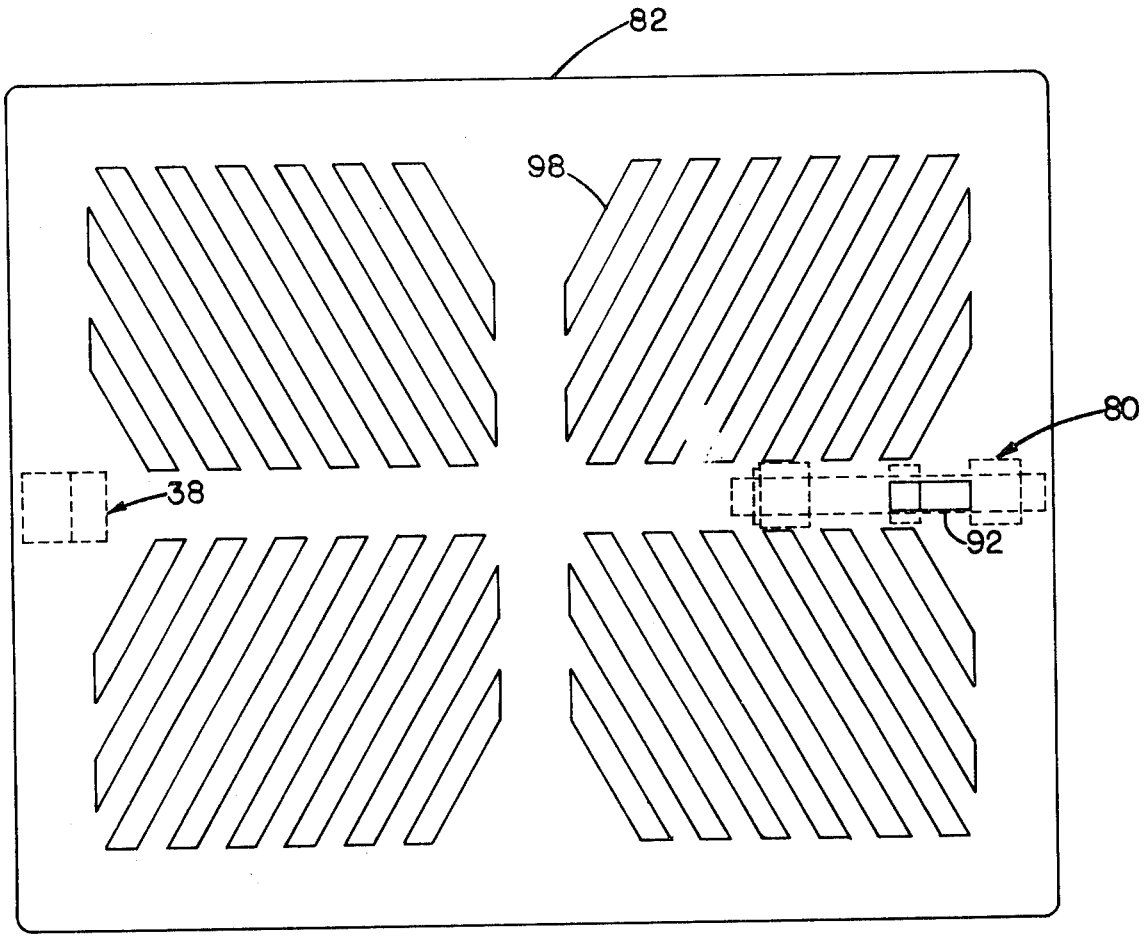
Figure 4:
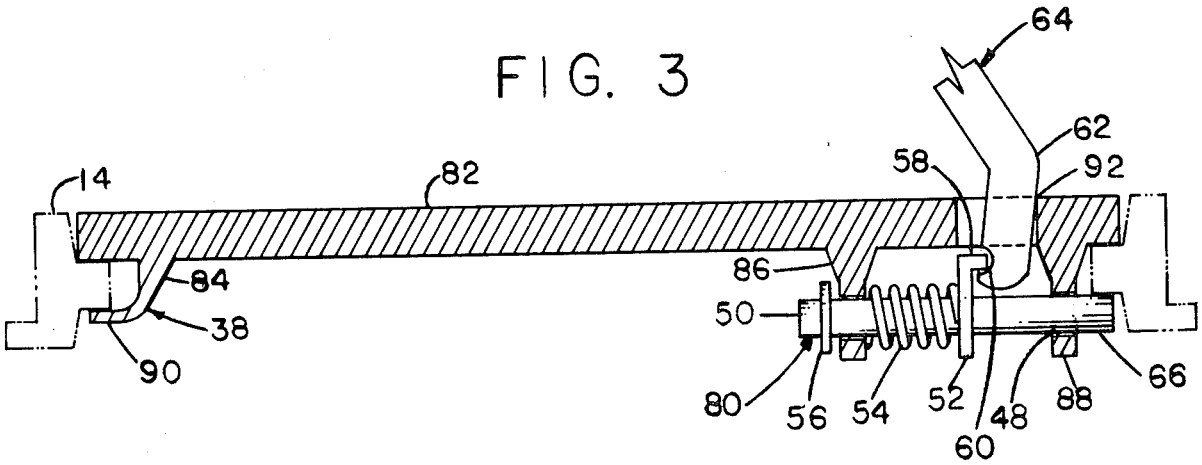

FIG. 3 is a top view of another embodiment of a catch basin grate and receiving frame locking assembly, which is substantially non removably secured to a catch basin grate, to in turn removably secure the catch basin grate to the surrounding receiving frame, which in turn is permanently built into the pavement; and FIG. 4 is a cross sectional view of the catch basin grate and receiving frame locking assembly, as shown in FIG. 3, illustrating how it is arranged in two respective subassemblies of integral depending structures, formed to both interlock directly with the receiving frame and also interlock indirectly, by receiving a horizontally movably locking member held in a locking position by a coiled compression spring subassembly, and moved out of a locking position upon the pivotal movement of a removable lever.

DESCRIPTIONS OF THE PREFERRED EMBODIMENTS

Figure 1:
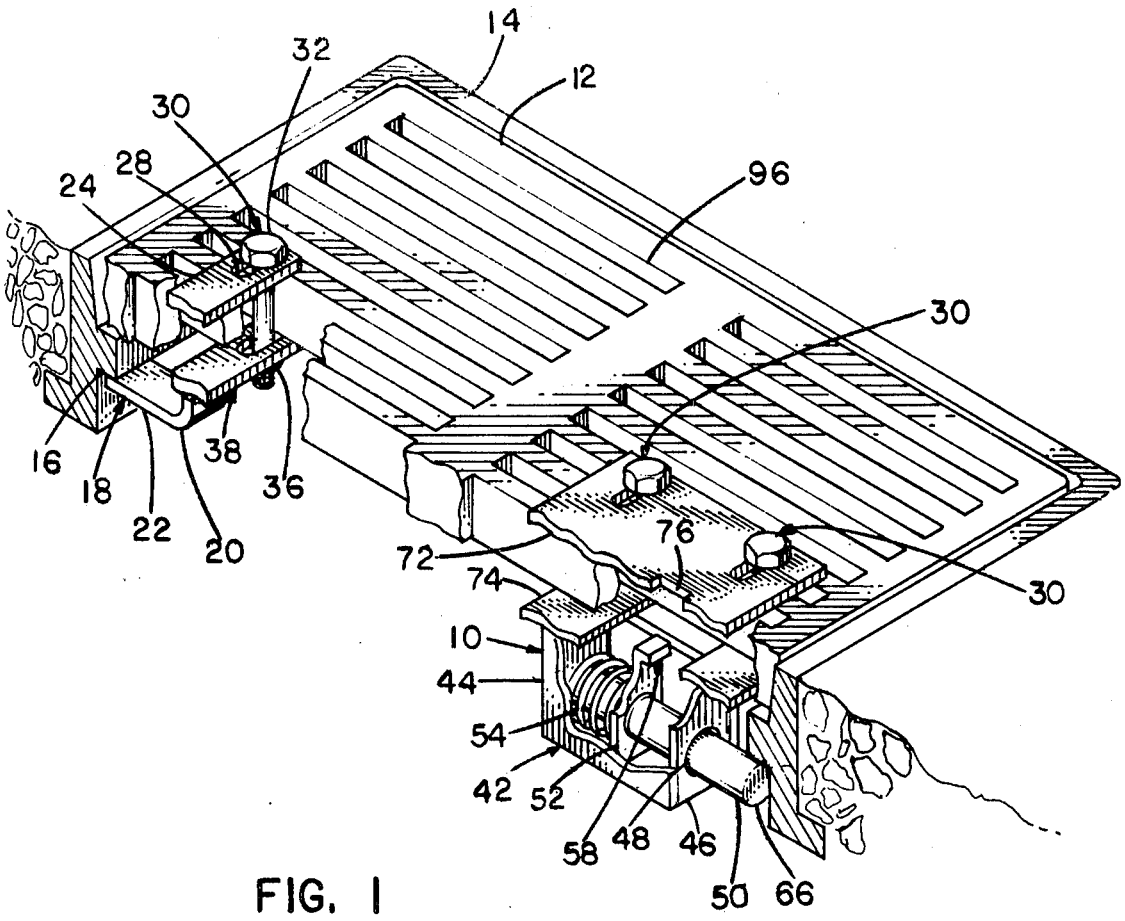
FIG. 1 is a partial perspective view of a catch basin grate and receiving frame locking assembly, which is removably secured to a catch basin grate, to in turn removably secure the catch basin grate to the surrounding receiving frame, which in turn is permanently built into the pavement.
Figure 2:
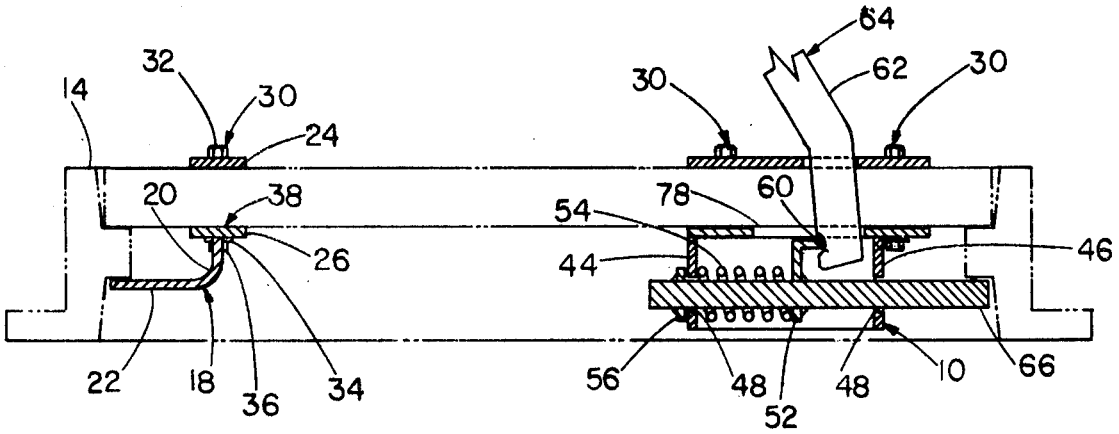
FIG. 2 is a cross sectional view of the catch basin grate and receiving frame locking assembly, as shown in FIG. 1, illustrating how it is arranged in two respective removable subassemblies of depending structures, secured to the catch basin grate and interlocked with the receiving frame, until unlocked by the pivotal movement of a removable lever.

Catch Basin and Receiving Frame Locking Assembly Which is Removably Secured to a Catch Basin Grate In FIGS. 1 and 2, a catch basin and receiving frame locking assembly 10 which is removably secured to a catch basin grate 12, is illustrated to indicate how presently installed catch basin grates 12 are fitted with this removable embodiment of this locking assembly 10. Most of the catch basin grates 12 installed today are not locked in place. Both vandals and thieves therefore are able to remove them, leaving a dangerous opening in the pavement defined by the size of the receiving frame 14. To avoid the possibility of such wrongful and dangerous removal, yet to allow the intentional removal by workmen, this catch basin and receiving frame locking assembly 10 is installed on the catch basin grate 12 to interfit with a ledge structure 16 of the receiving frame 14.

At one underside edge location on the catch basin grate 12, a subassembly 18 is secured. It comprises a depending structure 20 having a horizontal projection portion 22 positioned to interfit with ledge structure 16 of the receiving frame 14. The two components 20, 22 are held in place by using a top cross plate 24 placed on top of the catch basin grate 12, and a bottom cross plate 26 secured to the depending structure 20 and placed below the catch basin grate 12. Each of the cross plates 24 and 26 have aligned slotted holes 28, to receive fastener subassemblies 30, which include threaded bolts 32, washers 34, and nuts 36. Preferably the depending structure 20, the horizontal projection portion 22 and the bottom cross plate 26 are formed as an integral holding positioner 38.

At an opposite underside edge location on the catch basin grate 12, a subassembly 42 is secured. It comprises two spaced depending structures 44, 46 having aligned holes 48 to receive a horizontally movable locking member 50. On the locking member 50 is secured a movable spring contact washer 52 and around the locking member 50 is a compression coil spring 54 positioned between the movable spring contact washer 52 and the depending structure 44. Also there is a retaining washer 56 serving as a near end abutment on the locking member 50.

The movable spring contact washer 52 has a top horizontal projecting portion 58 to receive a notched portion 60 on the lower end 62 of a pivotal removable lever 64. Movement of the lever 64 retracts the horizontally movable locking member 50 against the force of the compression coil spring 54 to thereby clear its latching end 66 from under the ledge structure 16 of the receiving frame 14.

The horizontal movable locking member 50, and its related components inclusive of the two spaced depending structures 44, 46 are positioned on the catch basin grate 12, by using a top cross plate 72 and a bottom cross plate 74. The latter is secured to the two depending structures 44, 46. Each of the cross plates 72, 74 have slotted holes 28 to receive fastener subassemblies 30, each comprising a bolt 32, washer 34, and nut 36.

An access slot 76 in top cross plate 72 and a longer access slot 78 in bottom cross plate 74, are provided so the removable lever 64 is effectively pivoted to move the horizontally movable locking member 50. The movement of the latter clear of ledge structure 16 on the receiving frame 14, unlocks the catch basin grate 12. The cross-sectional size of the access slot 76 and the removal lever 64 are selected to obscure how unlatching occurs and also to forestall the use of any makeshift tool. Further, if an attempt were made to insert a small diameter bar or rod, as a makeshift tool, the resisting force of the compression coil spring 54 effectively deters such an attempt. Also during such possible attempt, a makeshift tool would tend to slip off of the top horizontal projecting portion 58 of the spring contact washer 52.

Catch Basin Receiving Frame Locking Assembly Which is Non Removably Secured to a Catch Basin Grate Having Integral Depending Structures In FIGS. 3 and 4, a catch basin and receiving frame locking assembly 80 is illustrated to indicate how catch basin grates 82 are initially manufactured to integrally include the respective depending structures 84, 86, 88. The first one 84, includes the integral horizontal projection portion 90 to interfit with the ledge structure 16 of the receiving frame 14. The other two 86, 88 with their aligned holes 48 slidably support the horizontally movable locking member 50. The other embodiment components such as the retaining washer 50, the spring contact washer 52 with its top horizontal projecting portion 58, compression coil spring 54 are also used in this embodiment.

The release of this catch basin and receiving locking assembly 80 is also undertaken by the pivotal movement of a removable lever 64 having a notched portion 60 on its lower end 62. The top horizontal projecting portion 58 on the spring contact washer 52 is contacted by the notched portion 60 of the removable lever 64. The latter is inserted through the access slot 92 initially formed in the catch basin grate 82, whenever it is to be used to unlock the catch basin grate 82. The cross-sectional size of the access slot 92 and the removal lever 64 are selected to obscure how unlatching occurs and also to forestall the use of any makeshift tool. The resisting force of the compression coil spring 54 and the horizontal projecting portion 58 on the spring contact washer 52 tend to cause a makeshift tool to slip when any unauthorized attempt is made to remove the catch basin grate 82.

Other Embodiments of Catch Basin and Receiving Frame Locking Assemblies

The embodiment 10 illustrated in FIGS. 1 and 2 is manufactured for installation on a catch basin grate 12, which initially was not manufactured to be locked in place. This embodiment 10, although illustrated in connection with catch basin grate 12 which has cross grate openings 96 perpendicular to one side and parallel to another side of the catch basin grate 12, is easily modified to fit other grates. For example by changing the arrangement of the slotted holes 28, then embodiment 10 is installed on a catch basin grate having diagonal grate openings 98, such as those openings 98 in catch basin grate 82.

Also the embodiment 80 may include integral portions of a catch basin grate having cross grate openings 96 perpendicular to one side and parallel to another side.

If a receiving frame is different from receiving frame 14 by not having a ledge structure 16, then a receiving flange may be welded or screwed to the inner side of such a receiving frame to provide a structure to receive the horizontal projection 22. Also at the opposite side a receiving hole may be drilled in the receiving frame, to receive the projecting end of the horizontally movable lock member 50.

I claim:

1. A combined catch basin grate locking assembly and unlocking lever tool to provide installed catch basin grates which are only conveniently and quickly removed by using the lever tool to unlock the catch basin grate from its receiving frame in turn secured to a supporting perimeter structure about an opening in a roadway or sidewalk, comprising:

(a) a subassembly for placement at one underside edge location on a catch basin grate, comprising, a first vertical depending structure and then an integral outwardly extending horizontal projection portion to underlap the receiving frame of the catch basin grate;

(b) another subassembly for placement at the opposite edge location on a catch basin grate, comprising, two spaced depending structures having aligned holes, a coiled compression spring and a movable spring contact washer having a hole aligned with the aligned holes of the two spaced depending structures, and also the movable spring contact washer having a horizontal projection portion at its top and on its side opposite to the coiled compression spring, and a horizontally movable locking member located throughout the aligned holes and partially within the coiled compression spring and also secured to the movable spring contact washer, and an end retaining washer secured to the horizontally movable locking member at its end nearest the central portions of a catch basin grate and positioned to allow the horizontally movable locking members, under the force the surrounding coiled compression spring, to interfit with a receiving frame, and thereby keep a catch basin grate locked to a receiving frame;

(c) elongated rectangular access structure on the catch basin grate to complementary receive a lever tool above the movable spring contact washer having a horizontal projection portion at its top and on its side opposite to the coiled compression spring; and (d) a lever tool having an elongated rectangular crossection to complementary fit the elongated rectangular access structure on the catch basin grate, having a notched portion to fit the horizontal projection portion of the movable spring contact washer, having an upstanding and angularly positioned hand grip portion above the notched portion to be pivoted to move the spring contact washer secured to the horizontally movable locking member, and to thereby move this locking member to an unlocked position so the catch basin grate may be pivoted upwardly and then removed.

2. A combined catch basin grate locking assembly and unlocking lever tool, as claimed in claim 1, wherein the elongated rectangular access structure is at the top level of the catch basin grate, and another longer elongated rectangular access structure is at the bottom level of the catch basin grate so the two, one above the other, receive the lever tool and control its movement during the authorized unlocking of the catch basin grate, and tend to forestall the use of any makeshift tools in unauthorized attempts to unlock the catch basin grate.

3. A combined catch basin grate locking assembly and unlocking lever tool, as claimed in claim 2, wherein both the subassembly having the depending structure having in turn a horizontal projection portion and the other subassembly having the two spaced depending structures having aligned holes, are both removably secured to a catch basin grate by respective fastening subassemblies, each fastening subassembly comprising a top cross plate for placement below and securement to the respective depending structures, aligned holes in both the top and bottom cross plates, and fastener subassemblies, utilizing the cross plates with their aligned holes, to secure the top and bottom cross plates in clamping positions adjacent respective top and bottom sides of a catch basin grate, and the top cross plate and the bottom cross plate of the other subassembly having the two depending structures are formed to respectively include the elongated rectangular access structure at the top level of the catch basin grate and the other longer elongated rectangular access structure at the bottom level of the catch basin grate.

* * * * *